US009834327B2

(12) United States Patent
De Rosa et al.

(10) Patent No.: US 9,834,327 B2
(45) Date of Patent: Dec. 5, 2017

(54) DEVICE FOR REFILLING A CONTAINER

(71) Applicant: MAITRISE ET INNOVATION, Val-de-Reuil (FR)

(72) Inventors: Daniel De Rosa, Louviers (FR); Alexandre De Rosa, Gravigny (FR)

(73) Assignee: Maitrise Et Innovation, Val-de-Rueil (FR)

( * ) Notice: Subject to any disclaimer, the term of this patent is extended or adjusted under 35 U.S.C. 154(b) by 47 days.

(21) Appl. No.: 15/031,123

(22) PCT Filed: Oct. 21, 2014

(86) PCT No.: PCT/FR2014/052672
§ 371 (c)(1),
(2) Date: Apr. 21, 2016

(87) PCT Pub. No.: WO2015/059399
PCT Pub. Date: Apr. 30, 2015

(65) Prior Publication Data

US 2016/0251096 A1 Sep. 1, 2016

(30) Foreign Application Priority Data

Oct. 24, 2013 (FR) ..... 13 60372

(51) Int. Cl.
*B65B 3/06* (2006.01)
*B05B 11/00* (2006.01)
*A45D 34/00* (2006.01)

(52) U.S. Cl.
CPC ..... *B65B 3/06* (2013.01); *A45D 34/00* (2013.01); *B05B 11/0097* (2013.01); *A45D 2034/002* (2013.01); *A45D 2034/005* (2013.01)

(58) Field of Classification Search
CPC ..... B65B 3/06; B05B 11/0097; A45D 34/00; A45D 2034/005; A45D 2034/002
USPC ..... 141/290, 302, 363–365, 383–386
See application file for complete search history.

(56) References Cited

U.S. PATENT DOCUMENTS 3,005,475 A * 10/1961 Beall, Jr. ..... B65D 47/248 137/588
4,314,657 A * 2/1982 Perakis ..... G01F 11/263 141/305
4,553,574 A * 11/1985 Le Donne ..... B67C 3/2637 141/250

(Continued)

OTHER PUBLICATIONS

International Search Report of corresponding PCT/FR2014/052672, dated Feb. 13, 2015.

*Primary Examiner* — Nicolas A Arnett
(74) *Attorney, Agent, or Firm* — Notaro, Michalos & Zaccaria P.C.

(57) ABSTRACT

A flow device having a body mounted in a sealing manner on a vessel, a spout arranged on an end opposite the vessel, a flow duct having a flow outlet situated on the spout and a flow inlet situated in the fitting portion, an air supply duct having an air inlet is situated on the body and an air outlet. The flow device also has a cap which is translationally moveable with respect to the body, the cap having a first valve and a second valve which cooperate respectively with a first valve seat formed by the flow outlet and a second valve seat which is separate from the first valve seat and is formed by the air inlet. A restoring element exerts a restoring force on the cap so as to keep the valves closed in the absence of an opposing force.

10 Claims, 5 Drawing Sheets

(56) References Cited

U.S. PATENT DOCUMENTS

| | | | | |
|---|---|---|---|---|
| 5,419,378 | A * | 5/1995 | Law | B65D 25/48 141/198 |
| 5,465,875 | A * | 11/1995 | Garnett | A01M 7/0092 134/166 R |
| 6,581,851 | B1 | 6/2003 | Murphy | |
| 8,925,593 | B2 * | 1/2015 | Lamboux | A45D 34/02 141/18 |
| 2007/0277902 | A1 | 12/2007 | Dieudont et al. | |
| 2016/0031597 | A1 * | 2/2016 | Dupont | B05B 11/0097 222/94 |

* cited by examiner

DEVICE FOR REFILLING A CONTAINER

The invention relates to the area of container refills, notably to the area of refills for individual perfume bottles.

Perfumes are usually presented in bottles where the esthetic appearance has been designed. Such bottles with a designed esthetic appearance are complex and expensive to produce. Thus, when the perfume bottle is empty, it is preferable to refill it again rather than throw it away. Refills comprising a vessel that has a less designed esthetic appearance are known for this, generally in the form of a simple cylindrical bottle. Such refills comprise the perfume which is intended to refill the esthetically designed perfume bottle again. During the refilling process, the perfume is transferred from the refill into the bottle.

Such refills allow, on the one hand, a perfume to be kept in the esthetically designed bottle and, on the other hand, a reserve of perfume to be kept in a simple refill which can provide a capacity in excess of that of the perfume bottle, a same refill therefore being able to serve for filling a same bottle a plurality of times. Furthermore, the use of a refill enables the production challenge to be reduced for the distribution of the perfume.

According to an embodiment, the invention supplies a flow device comprising a body, the body comprising:

- a fitting portion which is intended to be mounted in a sealing manner on a liquid vessel,
- a transfer portion which extends from the fitting portion and comprises a pouring spout which is arranged on an end opposite the fitting portion,
- a flow duct comprising a flow outlet which is situated on a side face of the spout and a flow inlet which is situated in an inside space of the fitting portion,
- an air supply duct comprising an air inlet which is situated on a side face of the transfer portion and an air outlet which is situated beyond the flow inlet in the direction of the fitting portion, the flow device further comprising a cap which is translationally movable with respect to the body along a sliding axis, in which the flow outlet forms a first valve seat of a first valve, the air inlet forms a second valve seat of a second valve which is separate from the first valve, the cap comprising a first valve which is suitable for cooperating with the first valve seat in order to close the flow duct and a second valve which is suitable for cooperating with the second valve seat in order to close the air supply duct, the device further comprising a restoring element which exerts a restoring force on the cap with respect to the body toward a closed position in which the first valve and the second valve are held on the first valve seat and on the second valve seat respectively in response to an opposing force.

One idea which provides the basis of the invention is to supply a refilling device which is simple to manufacture without requiring too large a number of parts. Another aspect of the invention starts from the idea of supplying a refilling device which is simple to use and does not require a significant number of steps in order to ensure the refilling of a container.

According to embodiments, such a flow device can comprise one or several of the following characteristics.

According to an embodiment, the air inlet is situated on a side face of the transfer portion between the spout and the fitting portion.

According to an embodiment, the air inlet is situated on a side face of the transfer portion between the spout and the fitting portion, a supporting wall of the cap being situated beyond the air inlet in the direction of the fitting portion, the supporting wall being intended to cooperate with a container to be filled by the container pressing against the supporting wall so as to exert the opposing force to the restoring force.

According to an embodiment, the air inlet forming the second valve seat and the second valve are situated in an inside space of the cap situated between the supporting wall of the cap and the fitting portion. A clearance between the fitting portion and the cap ensures the circulation of the air from the outside of the cap to the inside space of the cap. The air entering into the air duct circulates from part of the cap surrounding the fitting portion to the air inlet via the inside space of the cap separating the cap from the fitting portion then the inside space of the cap separating the cap from the transfer portion.

Such an embodiment allows the refill to be supplied with air from the surrounding air, without requiring interaction with the air contained in the bottle to be filled. The lack of interaction between the air supplying the refill and the air contained in the bottle allows the bottle to be filled to its maximum capacity.

According to an embodiment, an outside surface of the outer supporting wall of the cap comprises a rib. In a preferred manner, the outside surface of the supporting wall comprises a plurality of ribs. Such ribs allow a passage or passages of air to be created between the opening in the container and the outside surface of the supporting wall of the cap so as to facilitate the evacuation of the air contained in the container to be refilled.

According to an embodiment, the device further comprises a blocking device which is suitable for blocking the cap by sliding with respect to the body along the sliding axis of the cap so as to keep, on the one hand, the first valve on the first valve seat and, on the other hand, the second valve on the second valve seat. Such a blocking device avoids any unwanted opening of the valves.

According to an embodiment, the blocking device is also suitable for blocking the cap by sliding with respect to the body along the sliding axis of the cap so as to keep the first valve away from the first valve seat and, on the other hand, the second valve away from the second valve seat. By means of said embodiment, the valves can be kept in the open position so as to allow the liquid to flow in a continuous manner from the refill. Said embodiment avoids having to maintain pressure on the upper supporting surface of the cap so as to keep the valves open.

According to an embodiment, the flow outlet is oriented at an oblique angle with respect to an axis of the flow duct. Such an oblique angle of the flow outlet with respect to the axis of the flow duct allows for a better flow of the liquid in the container.

According to an embodiment, the side face of the transfer portion comprises a groove, the groove extending from the fitting portion to the second valve seat. In an advantageous manner, the second valve is facing the groove in the open position of the flow device. Such a groove allows air to pass from the clearance between the cap and the fitting portion to the second valve.

According to an embodiment, the invention also provides a refilling device which comprises a refill containing a liquid or pasty product and a flow device such as described above mounted on the refill.

The invention also provides a refill assembly comprising a refilling device such as described above and a container to be refilled, in which the length of the flow duct situated in the spout beyond the supporting wall of the cap of the flow device is greater than or equal to two thirds of the length of a neck of the container into which the spout is intended to be inserted. The length of the flow duct and the length of a neck of the container are defined along an axis of the flow duct. Such a length of the spout with respect to the neck of the container provides a good flow of the liquid into the bottle without risking the liquid spilling outside the bottle due to capillarity.

According to an embodiment, the spout has an outside diameter which is less than half the inside diameter of the neck of the container. Such a diameter of the spout ensures good evacuation of the air contained in the container and avoids flow blockages due to not being able to evacuate the air from the bottle.

According to an embodiment, the air supply duct and the flow duct are separate. Such separation between ducts allows liquid to flow from a liquid refill into a container without the air which is intended to replace the liquid evacuated from the refill troubling the flow of liquid into the container.

The invention will be better understood, and other aims, details, characteristics and advantages of the same will appear more clearly in the course of the following description of several specific embodiments of the invention, given purely for purposes of illustration and without limitation, with reference to the accompanying drawings.

Figure 1:
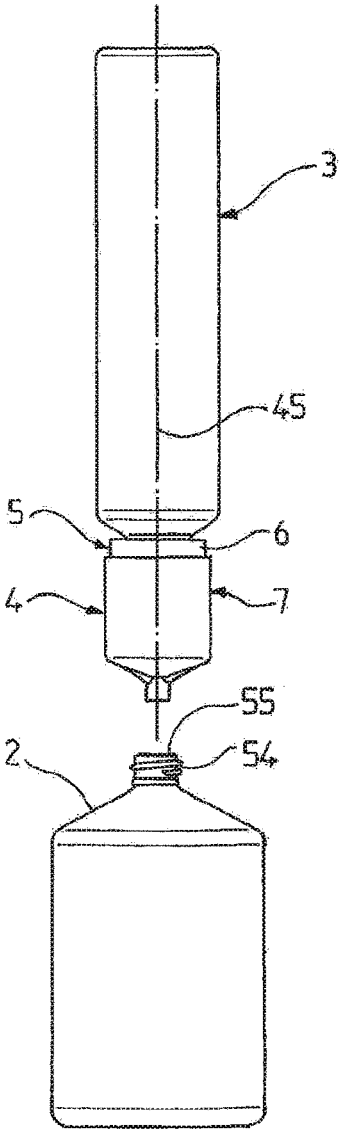
FIG. 1 is a side view of a refilling device which comprises a flow device which is intended to cooperate with a container and is positioned so as to be able to cooperate with the container.

A list of the references used in the figures is given below for information purposes only.

1. Refilling device
2. Container
3. Refill
4. Flow device
5. Body of device 4
6. Fixing part of body 5
7. Cap of 4
8. Opening of 3
9. Neck of 3
10. Screw thread of 9
11. Screw thread of 6
12. Transfer part of 5
13. Main portion of 12
14. Insertion portion of 12
15. Restoring element
16. Flexible rods of 15
17. Connecting ring of 15
18. Side wall of 7
19. Supporting wall of 7
20. Hollow distal tube of 7
21. Outside face of 19
22. Rib of 21
23. Outside side wall of 6
24. Inside face of 23
25. Plate of 6
26. Inside face of 25
27. Distal end of 9
28. Inside side wall of 6
29. Flow duct
30. Air supply duct
31. Flow inlet
32. Area of 26 delimited by wall 28
33. Flow outlet
34. Distal end of 14
35. Outside side face of 34
36. Distal face of 33
37. Axis of 29
38. First valve seat
A. Distal portion of 38
B. Proximal portion of 38
39. Air inlet
40. Outside side face of 13
41. Second valve seat
42. Proximal section of 30
43. Air outlet
44. Pin of 49
45. Sliding axis of 7
46. Inside wall of 7
47. Inside face of 19
48. Groove of 49
A. First section
B. Second section
49. Blocking device
50. Distal bulge of first valve
51. Proximal bulge of first valve
52. Proximal end of 46
53. Bulge of second valve
54. Neck of 2
55. Edge of 54
56. Groove
57. Space between 53 and 56
58. Liquid entering through flow inlet 31
59. Liquid circulating in 29
60. Liquid leaving through 33
61. Air circulating between 18 and 6
62. Air circulating through 57
63. Air circulating between 46 and 66
64. Space between 21 and 55
65. Circular cylindrical surface of 40
66. Distal bulge of inside wall 46
67. Distal cylindrical surface of 40

In a general manner, the terms "inside" and "proximal" qualify elements that are close to or oriented toward the refill 3 and/or the sliding axis 45 of the cap 7. In contrast, the terms "outside" and "distal" qualify elements which are remote from or oriented in the opposite direction to the refill 3 and/or the sliding axis 45 of the cap 7.

FIG. 1 shows a side view of a refilling device 1 which comprises a flow device 4 which is intended to cooperate with a container 2, for example a perfume bottle, a perfume dispenser, a spray or any other container 2 which is intended to contain liquid. The refilling device 1 is positioned upside down opposite said container 2. The refill assembly 1 contains a liquid, for example perfume, which is intended to be transferred into the container 2. The refilling device 1 comprises a refill 3 in which is stored the liquid which is intended to refill the container 2. The refilling device 1 further comprises a flow device 4. In a closed position of the flow device 4, the liquid contained in the refill 3 is not able to flow. In an open position of the flow device 4, the liquid contained in the refill 3 is able to flow outside the refilling device 1.

The flow device 4 comprises a body 5. Said body 5 comprises a fixing part 6 which is mounted in a sealing manner on the refill 3 in any appropriate manner, for example by means of complementary screw threads of the refill 3 and of the flow device 4, by means of a bayonet system comprising a sealing ring or similar. The flow device comprises a cap 7 which is mounted so as to be translationally movable on the body 5 along a sliding axis 45.

Figure 5:
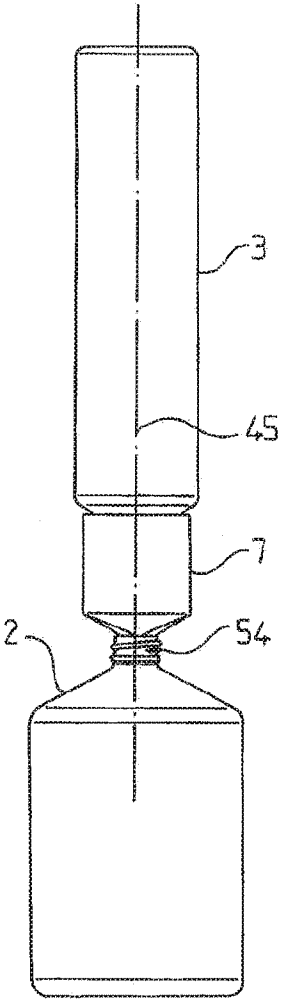
FIG. 5 is a side view of a refill assembly which comprises a flow device which cooperates with a container to be refilled, the flow device being therefore in an open position.

In the closed position of the flow device 4, the cap partially surrounds the fixing part 6 of the body 5. In contrast, and such as can be seen in FIG. 5, in the open position of the flow device 4, the cap 7 advantageously surrounds the fixing part 6 of the body 5 in an integral manner.

So as to transfer the liquid contained in the refilling device 1 into the container 2, the refilling device 1 is arranged upside down above the container 2, i.e. so that the flow device 4 is opposite an opening 8 in the container 2.

Figure 2:
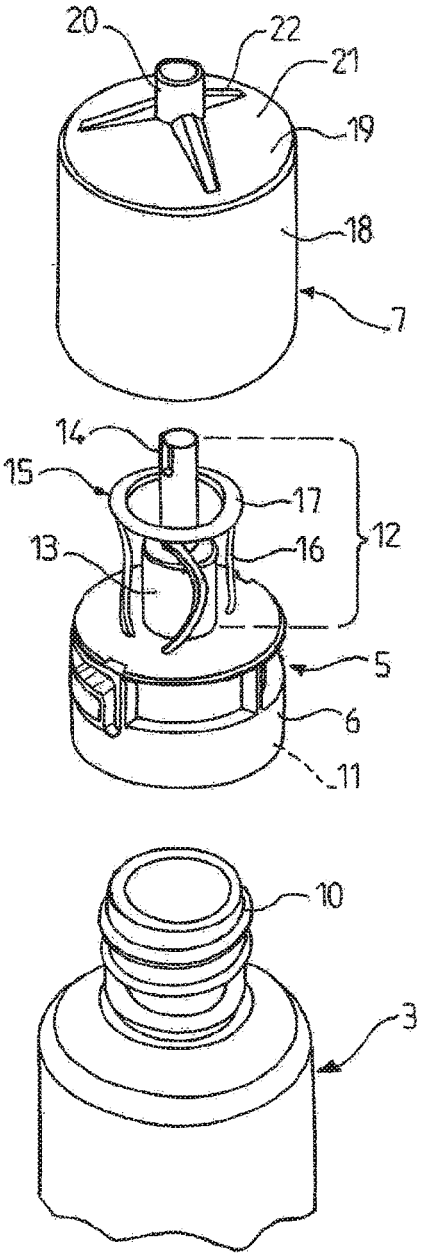
FIG. 2 is an exploded view of a refilling device which comprises a flow device which is composed by a body and a cap and is intended to be mounted on a refill.

FIG. 2 shows an exploded view of a refilling device which comprises a flow device which is composed of a body and a cap and is intended to be mounted on a refill.

The refill 3 is in the form of a bottle, a cylinder or similar. Said refill 3 comprises a neck 9. The neck 9 of the refill 3 comprises a screw thread 10 on an outside side face. An inside part of the neck 9 forms the opening 8.

The fixing part 6 of the body 5 comprises an inside screw thread 11 which is complementary to the screw thread 10 of the neck 9. The body comprises a transfer part 12. Said transfer part 12 comprises a main portion 13 and an insertion portion 14. The main portion 13 of the transfer part 12 connects the insertion portion 14 to the fixing part 6 of the body 5. The fixing part 6, the main portion 13 and the insertion portion 14 all have a form that is substantially circular cylindrical. The fixing part 6 has a diameter that is greater than the diameter of the main portion 13. The main portion 13 has a diameter that is greater than the diameter of the insertion portion 14.

A restoring element 15 surrounds the transfer part 12. Said restoring element 15 comprises three deformable flexible rods 16 which are arranged at regular spacings around the transfer part 12. Each flexible rod 16 is fixed on the fixing part 6 of the body 5. The ends of the three flexible rods 16 which are opposite the fixing part 6 are connected together by a connecting ring 17 which surrounds the transfer part 12. When a force is applied on the connecting ring 17, the three flexible rods 16 are compressed and the connecting ring 17 slides along the transfer part 12. When said force is no longer applied on the connecting ring 17, the three flexible rods 16 as well as the connecting ring 17 resume their starting position.

The cap 7 comprises a hollow circular cylindrical side wall 18, a supporting wall 19 and a hollow distal tube 20. The supporting wall 19 connects the side wall 18 and the hollow distal tube 20. An outside surface 21 of the supporting wall comprises a plurality of ribs 22. Said ribs 22 extend radially from the hollow distal tube 20, in a preferred manner at regular spacings. The supporting wall 19 comprises, for example, three ribs 22 which surround the hollow distal tube at regular spacings.

Figure 3:
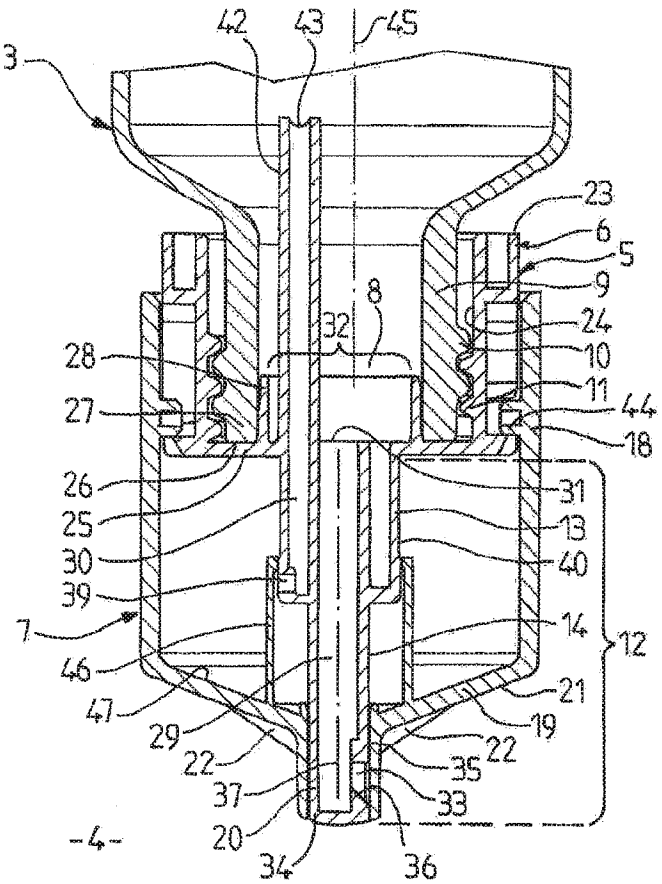
FIG. 3 is a sectional view of the assembly in FIG. 2 mounted in a closed position of the flow device.

FIG. 3 shows a sectional view of the assembly in FIG. 2 which is mounted in a closed position of the flow device.

The fixing part 6 of the body 5 comprises a circular cylindrical outside side wall 23. Said outside side wall 23 surrounds the neck 9 of the refill 3. The inside screw thread 11 of the fixing part 6 which is complementary to the screw thread 10 of the neck 9 is situated on an inside face 24 of the outside side wall 23 of the fixing part 6.

The fixing part comprises a plate 25. Said plate 25 is developed in a plane which is perpendicular to the outside side wall 23. An inside face 26 of the plate 25 rests on a distal end 27 of the neck 9.

The fixing part 6 also comprises a circular cylindrical inside side wall 28. Said inside side wall 28 is developed in a parallel manner to the outside side wall 23. The inside side wall 28 has an outside diameter which is complementary to the diameter of the opening 8 of the neck 9, that is to say is less than and close to the diameter of the opening 8.

The sealing between the fixing part 6 and the neck 9 is obtained by any appropriate means, for example by cooperation between the screw thread 10 of the neck 9 and the screw thread 11 of the outside side wall 23. Said sealing can also be obtained as a result of complementarity in form between the opening 8 in the neck 9 and the inside side wall 28 of the fixing part 6. Said sealing could also be obtained by a seal (not shown) for example situated between the plate 25 and the neck 9.

The body 5 comprises a flow duct 29 and an air supply duct 30.

The flow duct 29 crosses the main portion 13 and the insertion portion 14 of the transfer part 12 of the body 5. The flow duct 29 also crosses the plate 25 of the fixing part 6 of the body 5. A flow inlet 31 of the flow duct 29 opens out onto an area 32 of the inside face 26 of the plate 25 delimited by the inside side wall 28, that is to say in the opening 8 in the neck 9. An outlet 33 of the flow duct 29 opens out at one end 34 of the insertion portion 14 of the transfer part 12 which is opposite the main portion 13 of the insertion part 12. More particularly, the flow outlet opens out onto a side face 35 of the end 34 of the insertion portion 14.

In an advantageous manner, the flow outlet 33 comprises, within the thickness of the wall of the insertion portion 14, a distal face 36 which is inclined with respect to an axis 37 of the flow duct 29. Said distal face 36 forms, for example, an angle in the order of 45° with respect to the axis 37 of the flow duct 29. The flow outlet 33 forms a first valve seat 38 on the outside side face 35 of the insertion part 14.

The air supply duct 30 crosses the main portion 13 of the transfer part 12. An air inlet 39 of the air supply duct 30 opens out onto an outside side face 40 of the main portion 13. In a preferred manner, the air inlet opens out at one end of the outside side face 40 which is opposite the fixing part 6. Said air inlet 39 forms a second valve seat 41 which is separate from the first valve seat 38. The air supply duct 30 crosses the plate 25 of the fixing part 6. The air supply duct 30 comprises a proximal section 42 which protrudes into the inside space of the fixing part 6 delimited by the inside side wall 28 of the fixing part 6. An air outlet 43 of the air supply duct 30 opens out at the end of the proximal section 42 which is opposite the plate 25. In an advantageous manner, the air outlet 43 opens out into the refill 3 beyond the neck 9.

An inside diameter of the side wall 18 of the cap 7 is complementary to an outside diameter of the outside side wall 23 of the fixing part 6. Said complementarity allows the cap 7 to be displaceably guided by the outside side wall 23 of the fixing part 6. The displaceable guiding of the cap 7 is effected along a sliding axis 45. The displaceable guiding of the cap 7 is realized in a non-sealing manner such that a clearance between the side wall 18 of the cap 7 and the side wall 23 of the fixing part 6 allows the air to pass.

The hollow distal tube 20 of the cap 7 surrounds the insertion portion 14 of the transfer part 12 at least in part along the sliding axis 45. Said tube 20 forms a first valve which is intended to cooperate with the first valve seat 38 as explained below with respect to FIGS. 4A and 7A.

The cap 7 comprises an inside wall 46 which protrudes from an inside face 47 of the supporting wall 19 toward the plate 25 of the fixing part 6. As explained in more detail with regard to FIGS. 4B and 7B, said inside wall 46 of the cap 7 forms a second valve which is intended to cooperate with the second valve seat 41.

The restoring element 15 is supported, on the one hand, by the plate 25 and, on the other hand, by the inside face 47 of the supporting wall 19. In the absence of an opposing force, the restoring element 15 is in an equilibrium position or is compressed between the supporting wall 19 and the plate 25 so as to keep the cap 7 away from the fixing part 6 along the sliding axis 45.

Figure 4A:
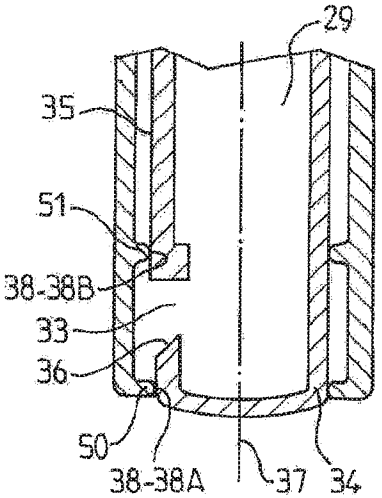
FIGS. 4A and 4B are sectional views of a detail of the first valve and of the second valve of the flow device in FIG. 3 respectively.

FIG. 4A shows a sectional view of a detail of the first valve of the flow device in FIG. 3, that is to say in a closed position of the flow device.

In said closed position of the flow device 4, the hollow distal tube 20 of the cap 7 surrounds the outside side face 35 of the insertion portion 14 of the transfer part 12 in an integral manner. A distal end which is opposite the supporting wall 19 of the hollow distal tube 20 comprises a bulge 50 on its inside face. Said bulge 50 is supported by a distal portion 38A of the first valve seat 38. Said distal portion 38A is formed by a circular cylindrical surface of the outside face 35 delimiting the distal end of the flow outlet 33, i.e. the end of the flow outlet 33 opposite the fixing part 6. Furthermore, the inside face of the hollow distal tube 20 comprises a proximal bulge 51 which is supported by a second portion 38B of the first valve seat 38. Said second portion 38B of the first valve seat 38 is formed by a circular cylindrical surface of the outside face 35 delimiting the end of the flow outlet 33, i.e. the end of the flow outlet 33 closest to the main portion 13. For reasons of simplicity of production, the distal bulge 50 and the proximal bulge 51 are advantageously developed over the entire outside contour of the insertion portion 14. The distal bulge 50 and the proximal bulge 51 together form the first valve which is complementary to the first valve seat 38. The supporting of the distal bulge 50 and of the proximal bulge 51 by the outside face 35 of the insertion portion 14 ensures the sealing of the first valve and blocks the flow duct 29.

Figure 4B:
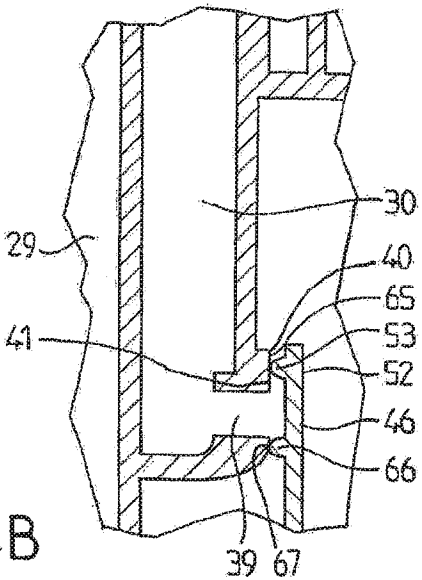

FIG. 4B shows a sectional view of a detail of the second valve of the flow device in FIG. 3, that is to say in an open position of the flow device.

The inside wall 46 of the cap 7 is developed along the main portion 13 of the transfer portion 12. A proximal end 52 of the inside wall 46, i.e. opposite the supporting wall 19, comprises a bulge 53 on the inside face of the inside wall 46. Said bulge 53 forms the second valve which is complementary to the second valve seat 41. The bulge 53 is supported by a circular cylindrical surface 65 of the outside side face 40 of the main portion 13. The circular cylindrical surface 65 by which the bulge 53 is supported delimits the proximal end of the second valve seat 41, i.e. the end of the second valve seat closest to the fixing part 6. The support of the bulge 53 is advantageously realized over the entire contour of the main portion 13. Said support ensures the sealing of the second valve 41 and blocks the air supply duct 30.

In said closed position of the flow device 4, the liquid contained in the refill 3 is not able to flow outside the refill 3. The tightness of the refill 3 is ensured on the one hand by the cooperation between the fixing part 6 and the neck 9, on the other hand, by the support of the bulges 50,51 and of the bulge 53 on the first valve seat 38 and on the second valve seat 41 respectively.

In one embodiment variant, the inside wall 46 of the cap 7 comprises a distal bulge 66. In the closed position of the flow device, said distal bulge 66 is supported in a sealing manner on a distal cylindrical surface 67 of the outside side face 40 of the main portion 13. Said distal cylindrical surface 67, on which the distal bulge 66 is supported in a sealing manner, delimits the distal end of the second valve seat 41. The support of the distal bulge 66 is advantageously realized over the entire contour of the main portion 13. Said sealing support of the distal bulge 66 on the distal cylindrical surface 67 avoids, in the closed position of the flow device, the liquid contained in the refill polluting the space between the cap 7 and the insertion part 12 by infiltrating along the distal cylindrical surface 67 of the main portion 13.

FIG. 5 shows a side view of a refill assembly 1 which comprises a flow device 4 which cooperates with a container 2 to be refilled, the flow device 4 being therefore in an open position.

So as to allow the transfer of liquid contained in the refill 3 into the container 2, the hollow distal tube 20 of the cap 7 is inserted into the opening 8 in the container 2, for example into a neck 54. To do this, the inside diameter of the hollow distal tube 20 is smaller than the diameter of the opening in the neck 54.

In a specific embodiment, the diameter of the insertion portion 13 is smaller than half, plus or minus 10%, the diameter of the opening in the neck 54.

In a specific embodiment, the length along the sliding axis 45 of the insertion portion is greater than or equal to two thirds of the length of the neck 54 along said same sliding axis 45.

The insertion of the distal tube 20 into the neck 54 of the container 2 brings the supporting wall 19 of the cap 7 into contact with an edge 55 of the neck 54. More specifically, the ribs 22 of the outside face 21 of the supporting wall 19 are brought into contact with the edge 55 of the neck 54. A space 64 is thus maintained between the outside surface 21 located between two ribs and the edge 55 of the neck 54.

In order to carry out the liquid transfer from the refill 3 toward the container 2, the refill assembly 1 is pressed against the neck 54 of the container 2 so that the neck 54 exerts a force, which opposes the force exerted by the restoring element 15, on the supporting wall 19. The force exerted by the neck 54 causes the cap 7 to slide along the sliding axis 45. The sliding of the cap 7 moves the cap 7 closer to the fixing part 6 along the sliding axis 45 such that the side wall 18 of the cap 7 surrounds the outside side wall 23 of the fixing part 6 of the body 5 in an integral manner. In said open position, the flow device 4 allows the liquid contained in the refill 3 to flow by gravity from the refill 3 into the container 2.

Figure 6:
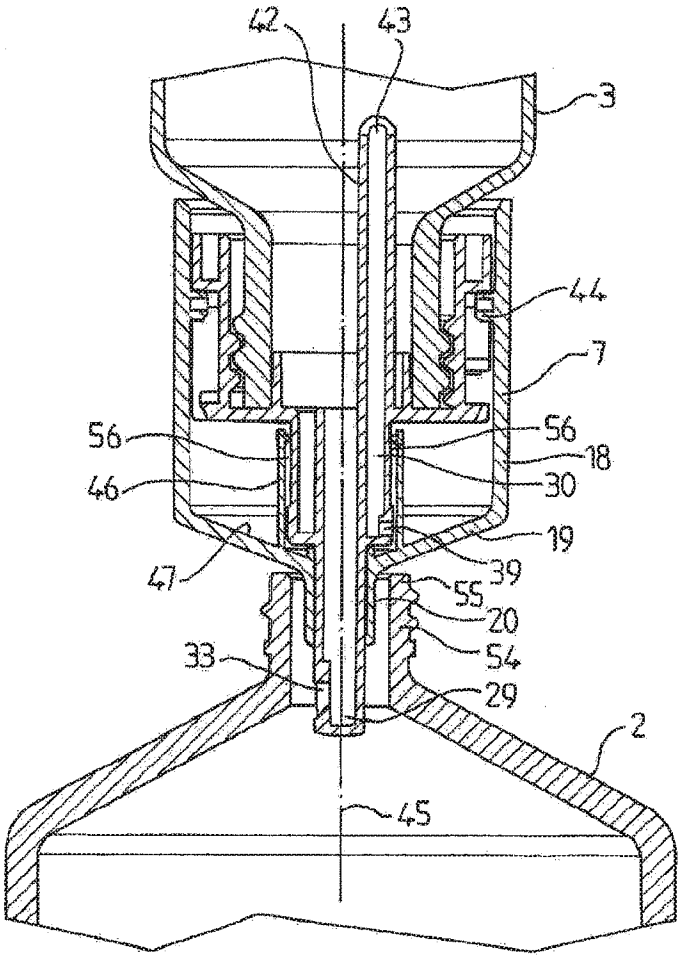
FIG. 6 is a sectional view of the assembly in FIG. 5.

As is visible in FIG. 6, during the sliding of the cap along the sliding axis 45 from the closed position of the flow device 4 to the open position of said flow device 4, the insertion portion 14 slides into the hollow distal tube 20 of the cap 7. Likewise, during said sliding, the proximal end 52 of the inside wall 46 of the cap 7 moves closer to the fixing part 6 of the body 5. The sliding of the insertion portion 14 into the hollow distal tube 20 opens the first valve. Likewise, the inside wall 46 moving closer to the fixing part 6 opens the second valve. The sliding of the cap 7 can be limited by the non-sealing stop of the side wall 18 of the cap 7 on the refill 3 or even by the non-sealing abutment of the inside wall 46 of the cap 7 against the plate 25 of the fixing part 6.

Figure 7A:
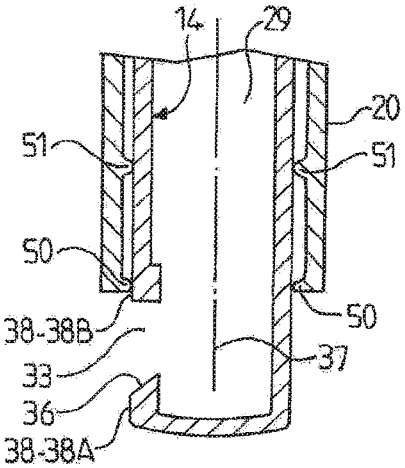
FIGS. 7A and 7B are sectional views of a detail of the first valve and of the second valve of the flow device in FIG. 6 respectively.

FIG. 7A shows a sectional view of a detail of the first valve of the flow device in an open position of the flow device.

The sliding of the insertion portion 14 into the hollow distal tube 20 of the cap 7 brings about the displacement of the bulges 50 and 51 of the hollow distal tube 20 with respect to the first valve seat 38. Typically, the sliding of the cap 7 with respect to the body 5 brings about the opening of the first valve. In fact, once the distal bulge 50 of the hollow distal tube 20 moves so as to be opposite the flow outlet 33, i.e. the distal bulge 50 is no longer supported by the distal portion 38A of the first vale seat 38, the tightness of the first valve is no longer assured. As the tightness of the first valve is no longer assured, the liquid contained in the refill 3 is able to flow by gravity from the refill 3 through the flow duct 29 and to be evacuated via the flow outlet 33. In the open position, the distal bulge 50 is advantageously supported by the proximal portion 38B of the first valve seat so as to allow maximum flow through the flow outlet 33.

In a preferred manner, the proximal bulge 51 is in constant sealing contact with the outside side face 35 of the insertion portion 14. Said sealing contact is advantageously maintained during the sliding of the proximal bulge 51 along the insertion portion 14. Such a constant sealing contact avoids any pollution of the cap 7 by liquid ingress between the cap 7 and the insertion portion 14 of the transfer part 12.

Figure 7B:
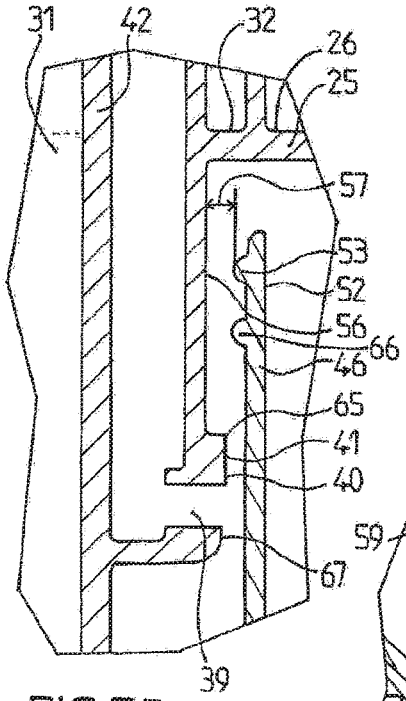

FIG. 7B shows a sectional view of a detail of the second valve of the flow device in an open position of the flow device.

When the proximal end 52 of the inside wall 46 of the cap 7 moves closer to the fixing part 6 of the body 5, the bulge 53 of the inside wall 46 moves along the main portion 13 of the transfer part 12. The movement of the bulge 53 of the inside wall 46 brings said bulge 53 opposite a groove 56 of the outside face 66 of the main portion 13. The bulge 53 and the groove 56 being opposite creates a space 57 between the bulge 53 and the outside face 66 of the main portion 13, the bulge 53 no longer being supported by the second valve seat 41. Said space 57 brings about the opening of the second valve such that the air supply duct 30 is no longer blocked.

In the variant in which the inside wall 46 comprises a distal bulge 66, the distal bulge 66 is also opposite the groove 56 so as not to block the passage of air when the flow device is in the open position.

Figure 7C:
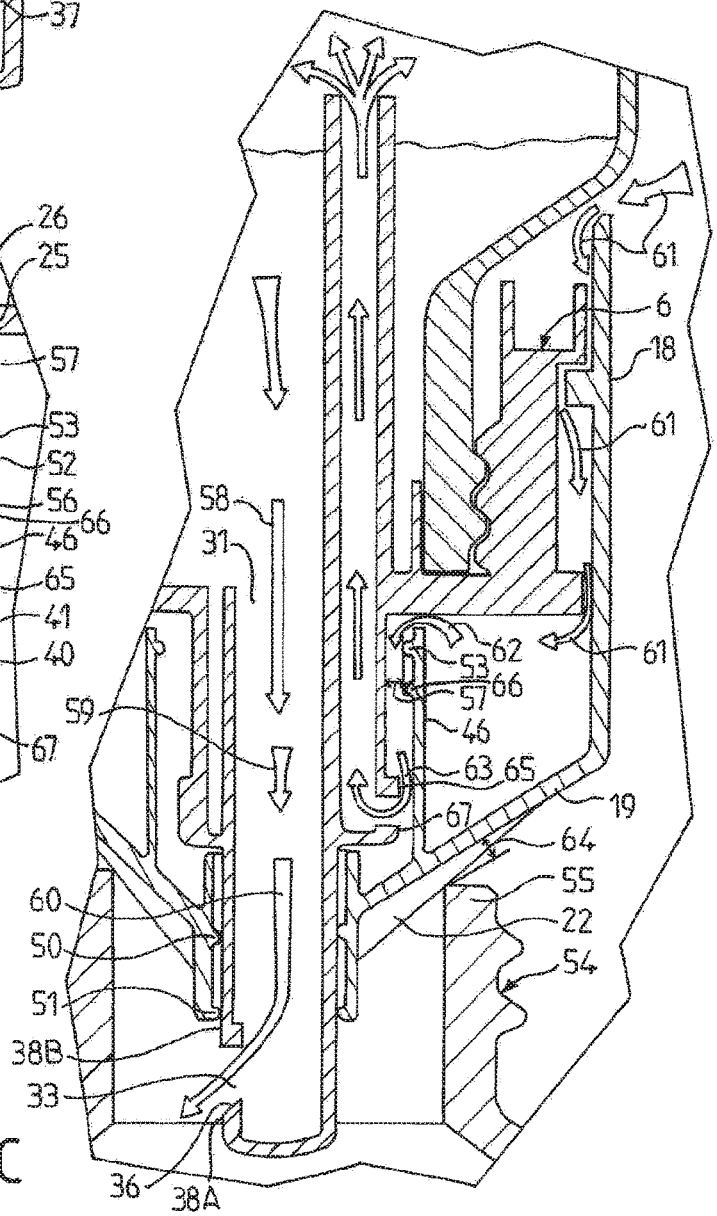
FIG. 7C is a sectional view of a detail of the refill assembly in FIG. 5 showing the pathway of the fluids through the flow device.

As is visible in FIG. 7C, when the flow device 4 is in the open position, the liquid contained in the refill 3 is able (arrow 58) to enter into the flow duct 29. The liquid circulates therefore (arrow 59) by gravity from the flow inlet 31 to the flow outlet 33. As the first valve is open, the liquid contained in the flow duct is evacuated (arrow 60) by gravity into the container 2 via the flow outlet 33.

So as to ensure pressure equilibrium, and therefore to replace the liquid of the refill 3 that has fallen into the container 2, the surrounding air, i.e. outside the refilling device 1 and outside the container 2, enters into the refill 3. More specifically, the surrounding air circulates from the outside of the flow device 4 toward the air supply duct 30 via (arrow 61) the clearance between the cap 7 and the fixing part 6 of the body 5, then (arrow 62) through the space 57 separating the bulge 53 of the inside wall 46 and the groove 56 of the main portion 13 of the transfer part 12, then (arrow 63) into the clearance separating the inside face of the inside wall 46 and the outside face 40 of the main portion 13 to the air inlet 39. The surrounding air thus enters into the air supply duct 30 to the air outlet 43 which opens out into the refill 3.

The air contained in the container 2 to be refilled is evacuated through the space 64 between the edge 55 of the neck 54 of the container 2 and the outside surface 21 of the supporting wall 19 of the cap 7 situated between two ribs 22.

Figure 8:
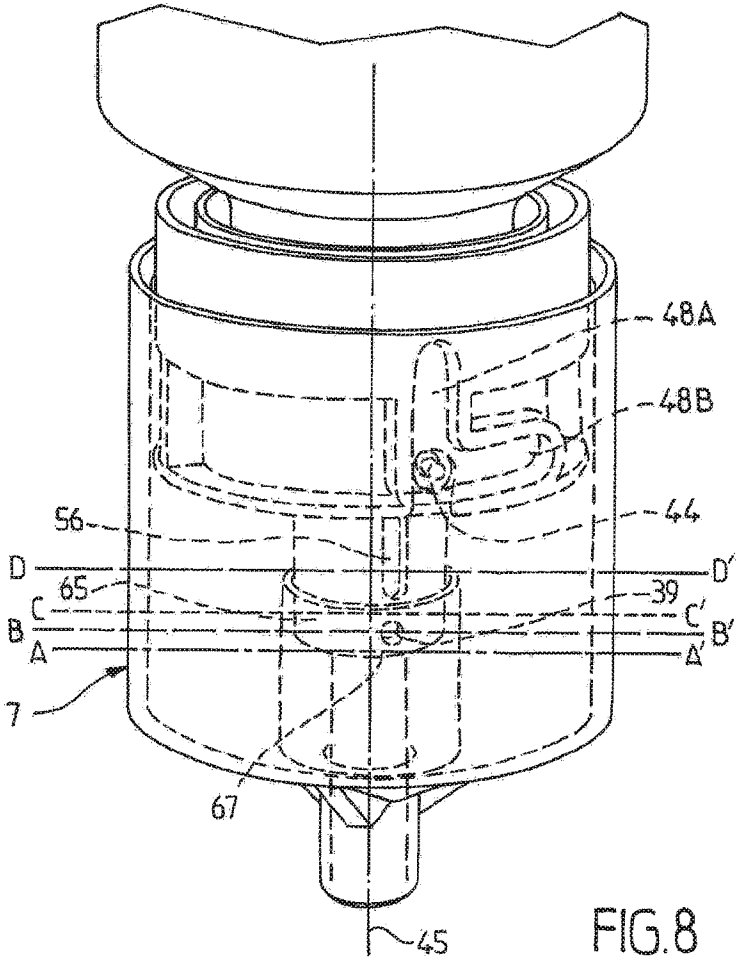
FIG. 8 is a schematic view in perspective showing an embodiment of the flow device in FIG. 1 which comprises a blocking system.

FIG. 8 is a schematic view in perspective showing an embodiment of the flow device 4 which comprises a blocking device 49.

The blocking device 49 comprises a groove 48 which is situated on the outside face of the outside side wall 23 of the fixing part 6 of the body 5. Said groove 48 comprises a first section 48A which is developed in a parallel manner to the sliding axis 45 of the cap 7. The groove 48 also comprises a second section 48B which is developed in a perpendicular manner to the sliding axis 45 of the cap 7.

The inside face of the side wall 18 of the cap 7 comprises a pin 44 which is accommodated in the groove 48. The pin 44 cooperates with the groove 48 so as to limit the movement of the cap 7 with respect to the body 5. The first section 48A of the groove 48 limits the freedom of movement of the cap 7 with respect to the body 5 along the sliding axis 45. The second section 48B of the groove 48 limits the freedom of rotary movement of the cap 7 with respect to the body 5.

In a position which is blocked for movement along the sliding axis 45 of the cap 7, the pin 44 is accommodated in a second section 48B of the groove 48 outside the extension of the first section 48A of the groove 48. The translational displacement of the cap 7 along the sliding axis 45 is therefore blocked by the abutment of the pin 48 against the walls of the second section 48B of the groove 48.

A single rotation of the cap 7 allows the pin 44 to be displaced into the second section 48B of the groove 48 so as to bring said pin 44 into the extension of the first section 48A of the groove 48. When the pin 44 is accommodated in the extension of the first section 48A, the cap 7 moves freely along the sliding axis 45 with respect to the body 5. In said position of the pin 44, in the first and second section 48A, 48B at the same time, pressure on the supporting wall of the cap 7, which opposes the restoring element 15, allows the cap 7 to slide along the sliding axis 45 and therefore to pass from the closed position to the open position of the flow duct 4. During said sliding, the pin 44 is moved in the groove 48 along the first section 48A.

When the pressure applied on the supporting wall 19 of the cap 7 is suppressed, the restoring element 15 returns the pin 44 into the extension of the second section 48B of the groove 48. A single rotation of the cap 7 therefore allows the sliding of the cap 7 along the sliding axis 45 to be blocked again.

In an embodiment not shown, the groove 48 comprises a third section. Said third section is developed in a parallel manner to the second section 48B of the groove 48. Said third section is fitted tightly to the first section 48A at one end of said first section 48A which is opposite the second section 48B.

When a force opposing the restoring element 15 brings the pin 44 into the extension of the third section, that is to say into an open position of the flow device 4, a single rotation of the cap 7 allows the pin 44 to be housed in the third section outside the extension of the first section 48A of the groove 48. When it is housed in the third section outside the extension of the first section 48A, the pin 44 blocks the translational displacement of the cap 7 with respect to the body 5 along the sliding axis 45 by means of abutment of the pin 44 against the walls of the third section. Said third section allows the flow device 4 to be blocked in an open position, in an analogous manner to the blocking of the flow device 4 by the second section 48B in the closed position.

Figure 9A:
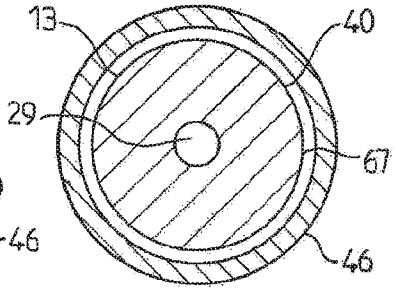
FIGS. 9A to 9D show sections of the main portion of the transfer part taken in section along the axes A-A' to D-D' respectively in FIG. 8.

FIG. 9A shows a section of the main portion 13 of the transfer part 12 taken along the axis A-A' of FIG. 8. In said section, the inside wall 46 of the cap surrounds the distal circular cylindrical surface 67 of the main portion 13.

Figure 9C:
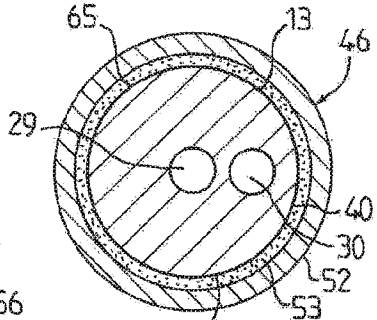
Figure 9B:
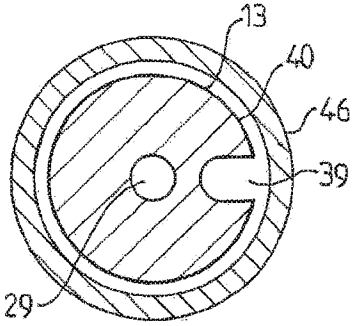

FIG. 9B shows a section of the main portion 13 of the transfer part 12 taken along the axis B-B' of FIG. 8.

FIG. 9C shows a section of the main portion 13 of the transfer part 12 taken along the axis C-C' of FIG. 8. In said section, the bulge 53 is sealingly supported by the circular cylindrical surface 65 of the outside side face 40 of the main portion 13. Said sealing support prevents the passage of outside air to the air supply duct 30.

Figure 9D:
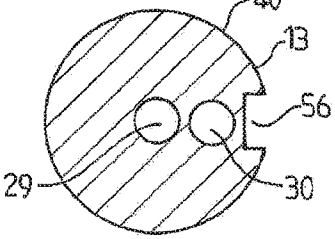

FIG. 9D shows a section of the main portion 13 of the transfer part 12 taken along the axis D-D' of FIG. 8.

In the open position of the flow device, the bulge 53 of the wall 46 is opposite the groove 56 at a distance 57 such that the tightness of the second valve 41 is no longer assured and the air is able to reach the inlet 39 of the air supply duct 30.

The technique described above in order to realize a refill assembly can be used in all types of areas in which a refill is intended to contain liquid that is more or less viscous in order to refill an empty container, for example within the framework of refills for individual perfume bottles, refills for essential oil bottles, for body cream or similar.

Although the invention has been described in connection with several specific embodiments, it is very obvious that it is in no way limited to these and that it includes all the equivalent techniques of means described as well as their combinations if they are within the framework of the invention.

For example, a refill can have any appropriate form, on the one hand, for containing a product in liquid or viscous form and, on the other hand, for receiving the flow device such as described above. Thus, the refill can be in the form of a cylindrical tube comprising a neck with a screw thread, or even a pocket with a flexible wall on which the flow device is thermo-welded or even a cube or a sphere comprising an opening in which the flow device or similar is able to be force fitted.

Likewise, different sizes of refills can be provided. A refill can thus contain a quantity of product which allows a partial filling of a container to be effected, a single complete filling of said container or, in contrast, a plurality of fillings of a same container.

Moreover, within the framework of a refill containing a product having a viscosity such that the product is not able to flow by simple gravity, an ejecting device can be provided. Such an ejecting device is, for example, constituted by a piston which is housed in contact with the product of the refill, the piston being displaced in the refill in order to eject the product. In a variant, the refill is formed by a flexible outside shell, for example in the form of a pocket containing the product; the refill can therefore be pressed by a user in order to eject the product.

The first valve and the second valve, which are shown in the description above and in the figures in the form of bulges 50, 51 and 53, can be realized in numerous other forms. The bulges 50, 51 and 53 can be replaced by flexible lips, grooves in which are accommodated O-ring seals, reliefs or any other appropriate form which allows tightness to be ensured.

Likewise, the restoring element can be in any form or material that is appropriate for exerting a restoring force. Thus, the restoring element is in the form of three resilient rods which are connected by a ring in the description above but it could be in the form of a spring, a plurality of rods with shape memory produced in methyl polyoxymethylene or any other element which is suitable for exerting a restoring force.

The use of the verb "to comprise", "to include" or "to encompass" and its conjugated forms does not exclude the presence of elements or stages other than those mentioned in a claim. The use of the indefinite article "a" or "an" for an element or a stage does not exclude, unless otherwise specified, the presence of a plurality of such elements or stages.

In the claims, any reference signs between brackets should not be interpreted as a limitation of the claim.

The invention claimed is:

1. A flow device (4) comprising a body (5), the body comprising:

a fitting portion (6) which is intended to be mounted in a sealing manner on a liquid vessel (3), a transfer portion (12) which extends from the fitting portion and comprises a pouring spout (14) which is arranged on an end opposite the fitting portion, a flow duct (29) comprising a flow outlet (33) which is situated on a side face (35) of the spout and a flow inlet (31) which is situated in an inside space of the fitting portion, an air supply duct (30) comprising an air inlet (39) which is situated on a side face (40) of the transfer portion and an air outlet (43) which is situated beyond the flow inlet in the direction of the fitting portion, the flow device further comprising a cap (7) which is translationally movable with respect to the body along a sliding axis (45), in which the flow outlet forms a first valve seat (38) of a first valve, the air inlet forms a second valve seat (41) of a second valve which is separate from the first valve, the cap comprising a first valve (50, 51) which is suitable for cooperating with the first valve seat in order to close the flow duct and a second valve (53) which is suitable for cooperating with the second valve seat in order to close the air supply duct, the device further comprising a restoring element (15) which exerts a restoring force on the cap with respect to the body toward a closed position in which the first valve and the second valve are held on the first valve seat and on the second valve seat respectively in response to an opposing force.

2. The flow device as claimed in claim 1, in which the air inlet is situated on a side face of the transfer portion between the spout and the fitting portion, a supporting wall (19) for the cap being situated beyond the air inlet in the direction of the fitting portion, the supporting wall being intended to cooperate with a container (2) to be filled by the container pressing against the supporting wall so as to exert the opposing force to the restoring force.

3. The flow device as claimed in claim 2, in which the air inlet forming the second valve seat and the second valve are situated in an inside space of the cap situated between the supporting wall of the cap and the fitting portion, a clearance between the fitting portion and the cap ensuring the circulation of the air from the outside of the cap to the inside space of the cap.

4. The flow device as claimed in claim 2, in which a supporting surface (21) of the supporting wall of the cap comprises a rib (22) which is intended to create a space between an opening in the container and the supporting surface of the cap.

5. A refilling device comprising:

a refill (3) containing a liquid or pasty product and a flow device as claimed in claim 2, the flow device being mounted in a sealing manner on a refill.

6. A refill assembly comprising a refilling device as claimed in claim 5 and a container to be refilled, in which the length of the flow duct situated in the spout beyond the supporting wall of the cap of the flow device is greater than or equal to two thirds of the length of a neck of the container, and in which the spout has an outside diameter which is smaller than or equal to half an inside diameter of the neck of the container.

7. The flow device as claimed in claim 1, the device further comprising a blocking device (49) which is suitable for blocking the cap by sliding with respect to the body along the sliding axis of the cap so as to keep, on the one hand, the first valve on the first valve seat and, on the other hand, the second valve on the second valve seat.

8. The flow device as claimed in claim 7, in which the blocking device is suitable for blocking the cap by sliding with respect to the body along the sliding axis of the cap so as to keep, on the one hand, the first valve away from the first valve seat and, on the other hand, the second valve away from the second valve seat.

9. The flow device as claimed in claim 1, in which the flow outlet is oriented at an oblique angle with respect to an axis of the flow duct.

10. The flow device as claimed in claim 1, in which the side face of the transfer portion comprises a groove (56), the groove extending from the fitting portion to the second valve seat.

* * * * *